United States Patent [19]

Seddon et al.

[11] Patent Number: 4,505,517

[45] Date of Patent: Mar. 19, 1985

[54] SELF-ADVANCING MINE ROOF SUPPORTS

[75] Inventors: James Seddon, Heskin; Frank Jones, Ashton-in-Makerfield, both of England

[73] Assignee: Dobson Park Industries PLC, Nottingham, England

[21] Appl. No.: 436,126

[22] Filed: Oct. 22, 1982

[30] Foreign Application Priority Data

Oct. 23, 1981 [GB] United Kingdom ..... 8131970

[51] Int. Cl.[3] ..... E21D 23/00

[52] U.S. Cl. ..... 299/31; 299/33; 405/291

[58] Field of Search ..... 299/11, 31–33, 299/43; 405/291, 295, 296

[56] References Cited

U.S. PATENT DOCUMENTS 4,029,361 6/1977 Beckmann et al. ..... 299/43 X
4,131,317 12/1978 Jamison et al. ..... 299/31
4,236,850 12/1980 Koppers et al. ..... 405/295 X
4,389,072 6/1983 Linke et al. ..... 299/43 X

FOREIGN PATENT DOCUMENTS 2089411 6/1982 United Kingdom .

*Primary Examiner*—Stephen J. Novosad
*Assistant Examiner*—Mark J. DelSignore
*Attorney, Agent, or Firm*—William A. Drucker

[57] ABSTRACT

A self-advancing mine-roof-support for use in or aligned with a main roadway or gate has a floor-engaging part and a roof engaging part spaced apart by extensible load-bearing prop or jack means, and engagement means for a face-conveyor and a transversely acting transfer conveyor whereby their relative positions are constrained to facilitate discharge of mineral from one conveyor to the other. The engagement means for the face conveyor comprises sliding anchor beams that assure maintenance of the relative attitudes of the support and the face conveyor and the transfer conveyor is held fore and aft of the support.

20 Claims, 6 Drawing Figures

SELF-ADVANCING MINE ROOF SUPPORTS

The invention relates to mine roof supports for application at the ends of a longwall face working.

In the known longwall method of mine-facing workings provision is made for material cut from the face to be removed by a conveyor extending along a roadway or gate at one end of the face. The material itself will, of course, usually be cut by a machine traversing the face in a direction transversely of the face-end roadway(s) or gate(s). Cut material will be loaded onto a face conveyor positioned in front of a row of face roof supports, usually below a roof-engaging member thereof. Longwall mine roof supports of the self-advancing kind serve both to advance the face conveyor towards the face as required and to advance themselves sequentially up to that advanced face conveyor, using said conveyor as an abutment or anchorage.

At one face-end, known as the main or loader gate, material cut from the face should be transferred in an efficient and orderly manner from the face conveyor to the roadway or gate conveyor for transportation directly or indirectly out of the mine workings to the surface.

Short transfer conveyors or stage loaders can be used for such transfer, i.e. at junction between face and roadway conveyors, but problems arise in affording both of strata support in the region of such junctions and proper relationship of the conveying systems with adequate access, especially as the face is advanced. Conventional support systems use hydraulic mine props and rigid roof bars which bridge the various elements of the overall conveying system in affording access. Such "prop and bar systems" of support have to be installed manually which is time-consuming and not well adapted to varying conditions as the face is advanced.

Certain proposals for overcoming these problems have been made by way of a special face-end roof-support of generally C-shape open towards the row of normal face supports and associated with a short transfer conveyor or stage loader serving to transport material discharged from the face conveyor and delivering it to the roadway or gate conveyor. As disclosed in that copending application, linkages and extensible props between floor-engaging and roof-engaging parts of such face-end supports are at a side of the transfer conveyor or stage loader. The transfer conveyor or stage loader is shown to be remote in the roadway from the end-most face support to allow maximum travel of the mining machine along the face. Also, provision is indicated for selectively latching the face conveyor to the face-end roof-support and for self-advancement by relative movement of support parts that are relatively leading and trailing in the direction of the roadway or gate.

Those proposals represent substantial improvements over the old prop-and-bar systems but we have now developed certain further improvements.

According to one aspect of this invention there is provided a self-advancing mine-roof-support for use in or aligned with a main roadway or gate, said support having a floor-engaging part and a roof-engaging part spaced apart by extensible load-bearing props or jacks, and engagement means for both of transversely acting conveyors whereby their relative positions are constrained to facilitate discharge of mineral from one of the conveyors (the face conveyor) to the other (transfer conveyor or stage loader).

Preferred embodiments have face-conveyor engagement means by way of sliding anchor beams that assure maintenance of the relative attitudes of a support and associated face conveyor, particularly where the anchor beams are associated with advancing rams or jacks whereby a support as a whole and a face conveyor are advanceable each using the other as an abutment or anchorage.

Such sliding anchor beams together with a location fore-and-aft of the support for the short transfer conveyor or stage loader enable holding of the desired directions of the conveyors and of a location of the end of the face conveyor above the short transfer conveyor or stage loader. Further jack or ram means may be provided acting between the transfer conveyor or stage loader and the floor-engaging part of the support to enable advancing of the former relative to the face conveyor.

Preferred lemniscate linkage between floor-engaging and roof-engaging parts of the face-end support may be located above the transfer conveyor or stage loader, components of the linkage being pivotally connected between the floor-engaging part and the roof-engaging part, say from a side thereof.

The face-end supports of our published British application No. 80/39971 represent logical and generally satisfactory provisions for mine face workings having coal seams of low and medium heights, which are substantially lower than the normal or desired height for the ensuing roadways or gates. The above-mentioned improvements hereof are also applicable for relatively high mine face workings where the seam thickness approaches, may even exceed, the desired roadway or gate height, or where the roof contours of excavation varies.

Dealing with uneven roof contours may be provided for by way of dividing the roof engaging part into two or more parts hingedly connected together with additional prop or jack means for support purposes, usually from the floor-engaging part but possibly between the roof-engaging parts.

For high seam workings it is most often the case that any difference between the face-height and the desired height of the face end roadway(s) or gate(s) will be substantially less than for low or medium height seam workings. Also, mineral cutting machines for such faces will usually remove webs of mineral one above the other successively at different heights in order to complete clearance of a nominal web width to the full face height. It is convenient to use machines with rotary cutting heads that are adjustable for height on suitable arms or linkages, such as ranging arm shearing machines which may be single or double ended. Such machines are usually readily rendered capable of cutting out an arch or roadway profile at the face-end and which may be above the normal height of the rest of the face at a level thus being suitable for the top of a face-end roadway or gate.

In general, another aspect hereof envisages that, at the ends of the face, a mining machine will be used to cut material in the face-end region both to a suitable width and profile for a face-end support of the type described. Then, a face-end support hereof has its roof-engaging part raisable to that height to engage an exterior shape that is generally curved or presents a roof engaging part at least roughly conforming to the shape cut out from the head of the face end.

Such a provision particularly facilitates conventional consolidation of the face-end roadway(s) or gate(s) packs behind the face-end support as it advances with the face, after which spaced arches clad with suitable panels can be emplaced without further cutting away of material. A raised working platform extending rearwardly from the back of the face-end support is particularly useful for the erection of such arches.

With further regard to forming face-ends as full-section continuations of roadways or gates, face-end supports hereof will generally be compatible with such sections. Then, of course, it is advantageous to provide a walk way preferably adjacent the face roof supports and on the opposite side of face-end support packs from the transfer conveyor or stage loader.

It is particularly advantageous for such a face end support hereof to offer protection from debris falling to each side of the roadway and maybe in the form of a generally crescent-shaped main roof-engaging part extending to a substantial extent downwards at the transfer conveyor or stage loader side. The extent of the crescent main roof-engaging part towards the face side of the roadway may be rigidly continuous to extend downwardly to the height of the face. Alternatively, and preferably, the crescent shaped main roof-engaging part maybe hinged to a head or crown part each part being supported by the above-mentioned further prop or props.

In general, face-end supports hereof are capable of accommodating and protecting drive or gear head of the face conveyor, and may have extensible roof bars forwardly to protect such drive and/or rearwardly to protect a working area where permanent arches are being set, after which the bars are retracted.

Should excavation of the face-end area by the mining machine for the face leave a tight corner in front of the face-end support which would obstruct advance of the equipment, the floor-engaging part the latter may conveniently be fitted with mineral cutting and loading means, say of auger type usually downwardly inclined and shrouded.

Practical implementation of the invention will now be described, by way of example, with reference to the accompanying drawings, in which.

Figure 1:
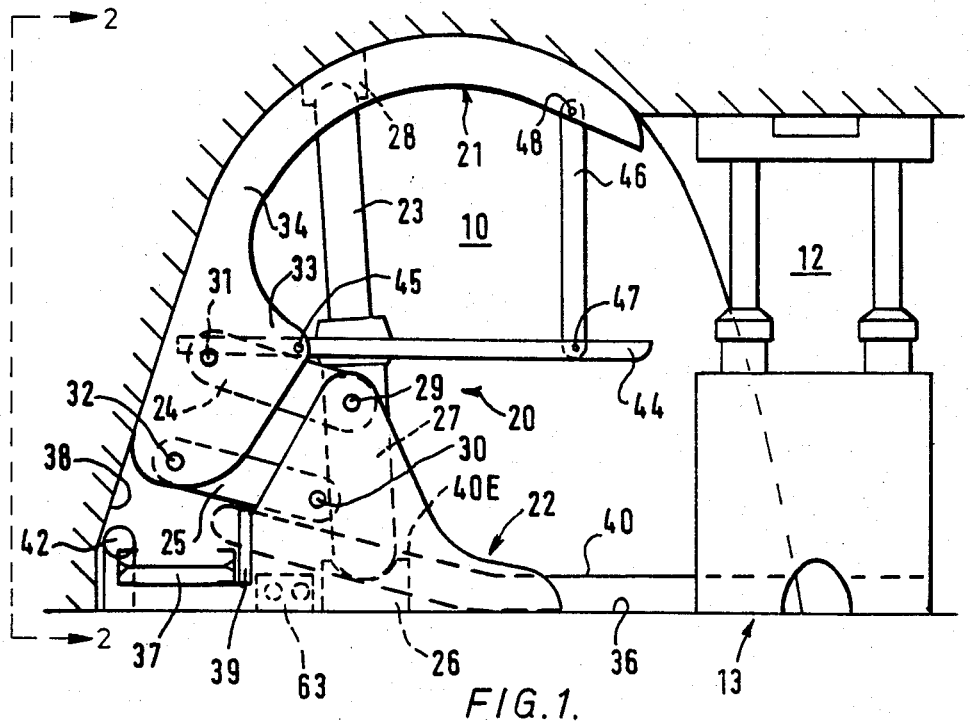
FIG. 1 is an end view of a face-end support seen from a face-end roadway or gate.
Figure 2:
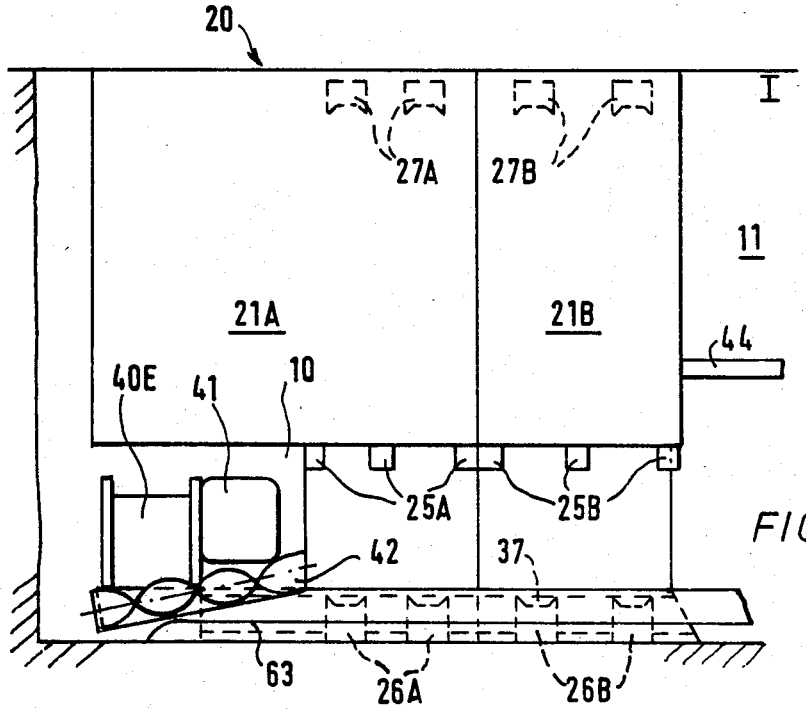
FIG. 2 is a traverse view of the same support on line 2—2.

Referring first to FIGS. 1 and 2, a face-end 10 is formed as an extension of a roadway or gate 11 at one side of a face 12. An end-most one of the normal row of side-by-side self-advancing roof supports of the face is shown diagrammatically at 13.

In the face-end 10 is face-end roof support 20 of generally C-shape having a floor-engaging part or base 22 and a roof-engaging part or canopy 21. At least the canopy 21 is in two parts 21A, 21B that are separately raisable and lowerable relative to the base 22. Similar suffixes A and B are used elsewhere as appropriate. Props 23 serve to effect raising and lowering of the canopy, in conjunction with lemniscate linkage means 24, 25 to assure substantially the same registration of canopy and base throughout raising and lowering.

The props 23 are hydraulic powered telescopic types shown with their cylinders seated in the base at 26 between upstands 27 and their rams seated at 28 in the canopy, such seatings affording required freedom of movement, being shown as part-spherical. The upstands 27 afford pivot joints 29, 30 for ends of parallel lemniscate links 24, 25 pivotted by their other ends at 31, 32 to inward extensions 33 from downward side extension 34 of the canopy 21.

The upstands 27 are shown substantially centrally of the base 22 between a protected walkway 36 next to the end-most face support 13 and a transfer conveyor or stage loader 37 located on the other side of the face-end support 20, i.e. adjacent the face-end side-wall 38 effectively forming an extension of the side-wall of the roadway or gate. A spill plate 39 prevents material falling from the stage loader 37.

The positions of the lemniscate linkages indicated in FIG. 2 actually flank the props 23 that are shown only in FIG. 1 with only positions of seatings 26, 27 shown in FIG. 2. As shown, there is a substantial cantilever of the forward part of the canopy above face conveyor 40, its gear box 41, and drive head unit 40E supplying the stage loader 37. In practice, such cantilever will, in fact, be more than the width of the conveyor 40. A side-mounted, downwardly and forwardly directed auger cutter is shown at 42 for clearing a corner that may restrict the face support advance due to the use of a rotary shearing head mining machine.

FIGS. 1 and 2 further show a raised working platform 44 at the back of the face-end support 20 for use in the installation of conventional arches to support the roadway or gate as the face-end support 20 is advanced with the face advance. As shown, the platform is conveniently and advantageously supported pivotally at 45 directly to rear-most canopy extension 33, and indirectly via link 46 end-pivoted thereto at 47 and to the canopy 21 at 48.

Figure 3:
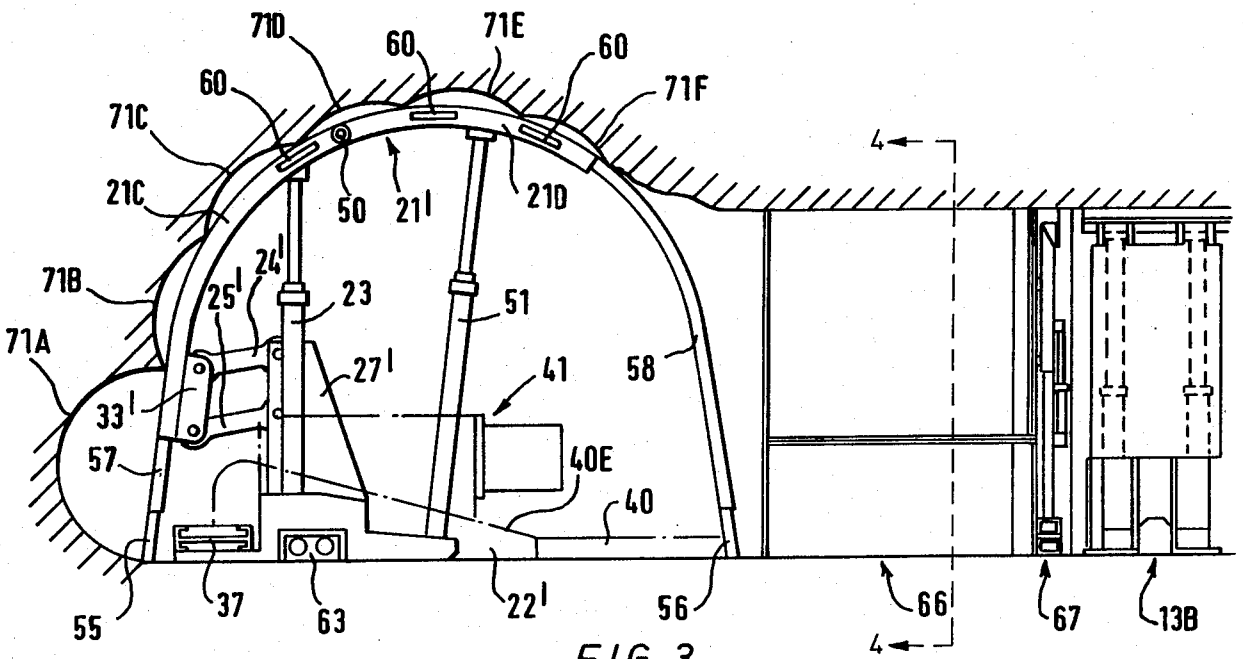
FIG. 3 is a view similar to that of FIG. 1 but of another face end support.
Figure 4:
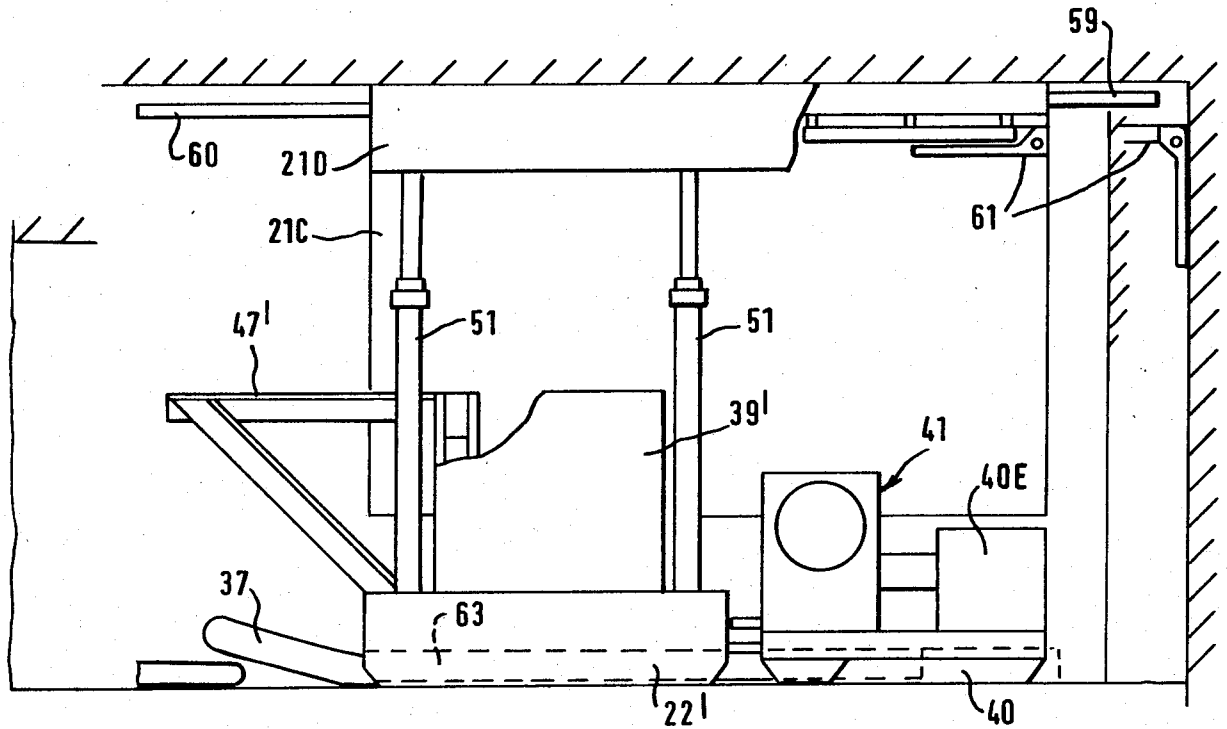
FIG. 4 is a transverse view on line 4—4.
Figure 5:
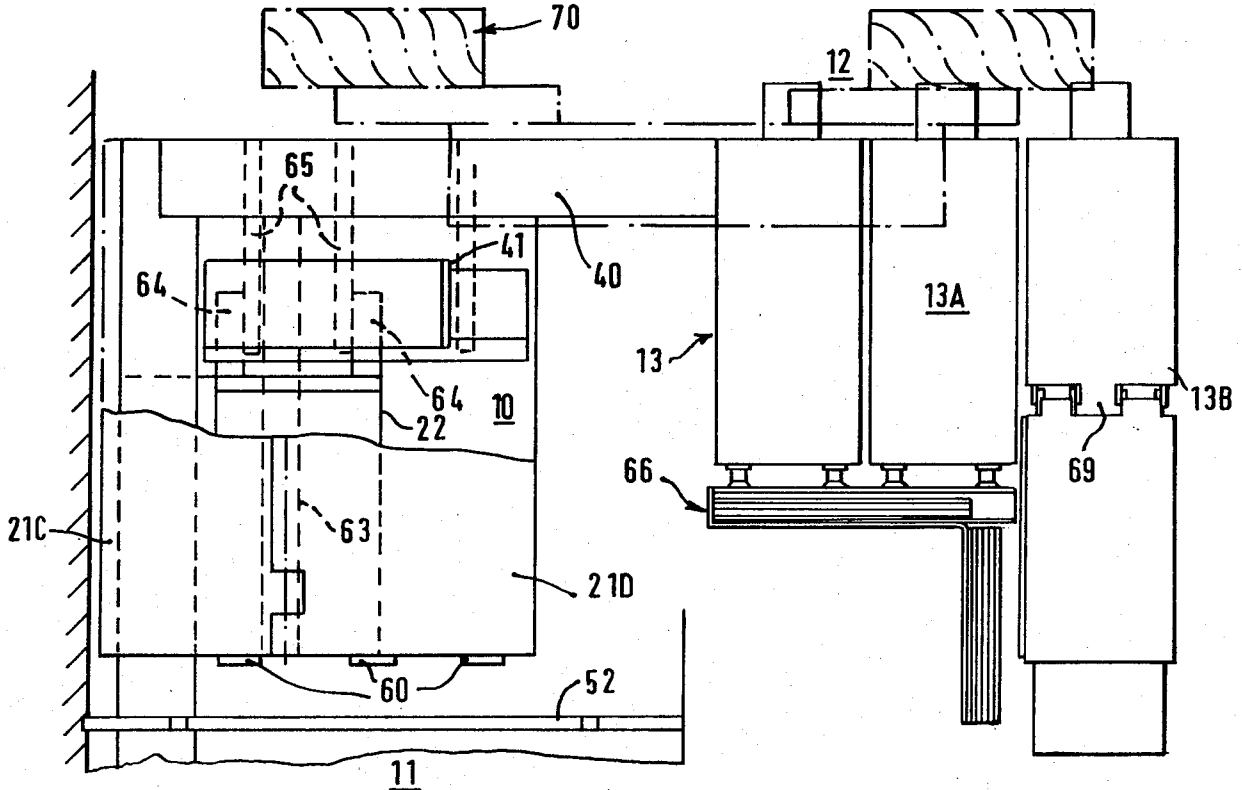
FIG. 5 is a plan view of that other support.

Turning to FIGS. 3 to 5, similar references are used where appropriate. The main differences arise from the canopy being split 21C, 21D fore-and-aft rather than transversely. Main canopy part 21C engaged by props 23 is, of course, still generally crescent shaped extending down over the stage loader 37 with linkage extensions 33'. However, it is hinged at 50 to a crown canopy part 21D supported by second props 51 that register with those 23, see FIG. 4. Also the raised working platform 47' is here carried rigidly by the base 22'. FIG. 5 also shows a standard roadway support arch 52 erectable from the platform 47'.

Also shown in FIGS. 3, 4 and 5, are various other features including guided advanceable connection to the face conveyor, see double ram anchor beam 63 (also indicated in FIGS. 1 and 2).

Telescopic stilts 55, are shown extending from the arch 52 to the floor beyond the stage loader 37. Also, other telescopic stilts 56 are shown extending from the arch 52, on the otherside of the support.

Furthermore, extensible roof bars 59, 60 are shown to the front and rear of the face-end support to protect newly cut roof and rearward working platform, respectively. Also, at the forward end an extensible face supporting sprag plate mechanism is shown at 61.

Regarding the face-support itself, anchoring and advancing ram means is shown at 63, in twin ram form due to the size of the face end support and the requirement to preserve relative positions of the conveyors. In this case, the base 22' is unitary and the rams 63 serve both to advance the face conveyor and gear head 40, 41 relative to the face-end support with the latter fixed floor-to-roof and to advance the face-end support with the face conveyor and gear head fixed by roof-supporting clamping of the normal face supports, or using the arch 52 as an abutment. Mutual guidance of the face-end support and face conveyor drive head is indicated at 64, 65 also serving to locate against relative displacement of the face conveyor down the face.

Certain other overall features of a preferred face-end utilising a face-end support hereof are also shown in FIGS. 3 to 5. Thus, the end-most face support 13, and the next one 13A, are shown with a rearward shield system 66 directly at their backs and an extension 67 thereof rearwardly alongside the next further face support 13B. The latter is shown as a composite support of which forward and rearward parts are intercoupled at 69. The shields 66, 67 are adjustable via rams and linkages and the whole of this part of the face-end arrangement affords space and accommodation for pump-packing process FIG. 5 only also indicates a double-headed rotary shearing mining machine at 70 that traverses and is guided along, the face conveyor 40. Support means, usually arms or other suitable linkages, for the shear heads allow for height adjustment thereof. As preferred herein, such height adjustment is to be beyond the normal seam and thus face height so as to be able to cut out a roughly arched crown of the face-end see the successive contours 71A to 71F in FIG. 3.

The face-end support mounted cutter 42 of FIGS. 1 and 2 would, of course, be required only if the lowest contour 71A could not be fully achieved, and hence is not shown in FIGS. 3 to 5.

Further, we point to the indicated splitting of the base 22 in FIGS. 1 and 2, in respect of which ram advancing means (not shown) would preferably operate in two parts and stages, one relative to the face conveyor and the forward support part and the other between the two support parts. However, a single stage system operated between the support parts could be used if the face conveyor drive head gear was fixed to the forward face-end support part.

Figure 6:
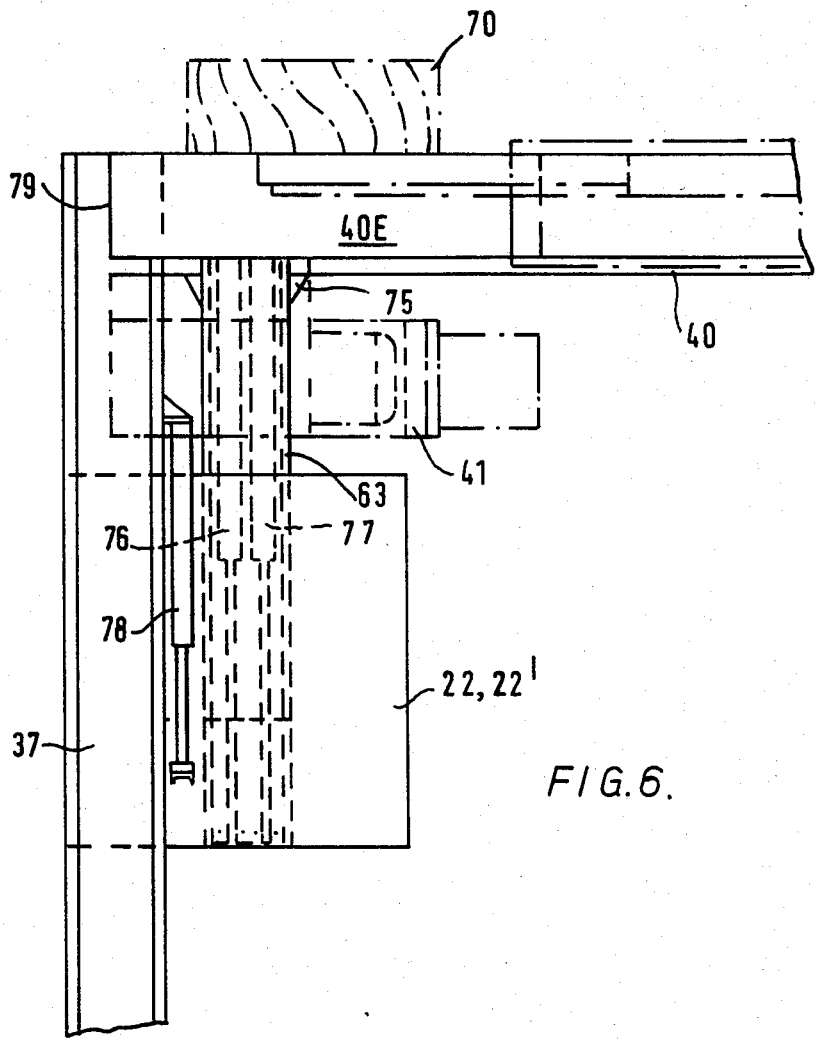
FIG. 6 shows details of particular conveyor engagement means.

Finally, we refer to FIG. 6 for details of a particular conveyor engagement and mutual location system. A support base 22, 22' houses and guides a beam 63 fixed at 75 to the face conveyor 40 via its drive head unit 40E. The beam is shown driven by twin hydraulic rams 76, 77 and a further ram 78 is shown for adjusting the transfer conveyor or stage loader 37 transversely of delivery end 79 of the face conveyor. The stroke of the ram 78 will usually allow significant forward movement of the transfer conveyor or stage loader 37 generally in the direction of the gate or roadway. It should be clear that the system shown in FIG. 6 ensures desired lateral relative location and directions of the face conveyor and the transfer conveyor or stage loader, whilst permitting longitudinal adjustment of the latter.

We claim:

1. A self-advancing mine-roof-support for use aligned with a main roadway or gate, said support having a floor-engaging part and a roof-engaging part spaced apart by extensible load-bearing prop means, and conveyor location means for constraining the relative positions of two transversely acting conveyors to facilitate discharge of mineral from one of the conveyors to the other, the roof-engaging part extending from the prop means laterally of the direction of the roadway or gate, which direction corresponds to the direction of action of means for advancing the support.

2. A support as claimed in claim 1 wherein one of the conveyors is a face conveyor and the other is a transfer conveyor.

3. A support as claimed in claim 2 wherein the transfer conveyor is held fore-and-aft of the support for action in the direction of the gate or roadway.

4. A support as claimed in claim 3 comprising ram means for acting between the transfer conveyor and the floor-engaging part of the support to enable advancing of the former relative to the face conveyor.

5. A support as claimed in claim 1 wherein said face conveyor engagement means comprises sliding anchor beams that assure maintenance of the relative attitudes of the support and its associated face conveyor.

6. A support as claimed in claim 5 wherein the anchor beams are associated with advancing ram means, whereby the support as a whole and the face conveyor are advanceable each using the other as an anchorage.

7. A support as claimed in claim 1 having a lemniscate linkage between the floor- and roof-engaging parts.

8. A support as claimed in claim 7 wherein the lemniscate linkage is located above the transfer conveyor, components of the linkage being pivotally connected between the floor-engaging part and the roof-engaging part.

9. A support as claimed in claim 8 wherein the components of the lemniscate linkage are connected to sides of the floor- and roof-engaging parts.

10. A support as claimed in claim 1 wherein the roof-engaging part is in two sections hingedly connected together with additional support means therefor.

11. A support as claimed in claim 10 wherein the additional support means is prop or jack means from the floor-engaging part or between the two sections.

12. A support as claimed in claim 1 having a raised working platform extending rearwardly from the back of the support.

13. A support as claimed in claim 1 having forwardly extensible roof bars.

14. A support as claimed in claim 1 having mineral cutting and loading means fitted to the floor-engaging part.

15. A support as claimed in claim 14 wherein the cutting and loading means is of the auger type.

16. A support as claimed in claim 15 wherein said auger is downwardly inclined away from the support.

17. A support as claimed in claim 15 or 16 wherein the said auger is shrouded.

18. A self-advancing mine-roof-support for use in or aligned with a main roadway or gate, said support having a floor-engaging part and a roof-engaging part spaced apart by extensible load-bearing prop or jack means, and engagement means for both of transversely acting conveyors, whereby their relative positions are constrained to facilitate discharge of mineral from one of the conveyors to the other, wherein the roof-engaging part is generally crescent shaped and extends to a substantial extent downwards at the transfer conveyor side of the support.

19. A support as claimed in claim 18 wherein the extent of the crescent roof-engaging part towards the face side of the roadway is rigidly continuous to extend downwardly to the height of the face.

20. A self-advancing mine-roof-support for use in or aligned with a main roadway or gate, said support having a floor-engaging part and a roof-engaging part spaced apart by extensible load-bearing prop or jack means, and engagement means for both of transverseley acting conveyors, whereby their relative positions are constrained to facilitate discharge of mineral from one of the conveyors to the other, wherein the roof-engaging part is generally crescent shaped and is hinged to a head or crown part each part being supported by one or more further prop means.

* * * * *